US011723418B2

(12) United States Patent
Scott

(10) Patent No.: US 11,723,418 B2
(45) Date of Patent: Aug. 15, 2023

(54) FISTULA SLEEVE

(71) Applicant: Michael W. Scott, De Pere, WI (US)

(72) Inventor: Michael W. Scott, De Pere, WI (US)

( * ) Notice: Subject to any disclaimer, the term of this patent is extended or adjusted under 35 U.S.C. 154(b) by 0 days.

(21) Appl. No.: 17/105,113

(22) Filed: Nov. 25, 2020

(65) Prior Publication Data

US 2022/0160060 A1 May 26, 2022

(51) Int. Cl.

| | |
|---|---|
| ***A41D 13/08*** | (2006.01) |
| ***A41D 13/00*** | (2006.01) |
| ***A41D 27/10*** | (2006.01) |

(52) U.S. Cl.

CPC ..... *A41D 13/08* (2013.01); *A41D 13/0002* (2013.01); *A41D 27/10* (2013.01); *A41D 2300/32* (2013.01); *A41D 2600/00* (2013.01)

(58) Field of Classification Search

CPC .. A41D 13/08; A41D 13/088; A41D 13/0002; A41D 27/10; A41D 2300/32; A41D 2600/00; A41D 13/00; A41D 31/305; A41D 13/12; A41D 13/1209; A41D 13/1236; A41D 13/1245; A62B 17/00; A61F 5/0118; A61F 2007/0035; A61F 2007/0034; A61F 2013/00119; A61F 13/102; A61F 13/108; A61F 5/05858;

(Continued)

(56) References Cited

U.S. PATENT DOCUMENTS 4,047,250 A * 9/1977 Norman ..... A41D 13/088 2/161.1
4,190,906 A * 3/1980 Patton, Jr. ..... A41D 13/088 2/917

(Continued)

FOREIGN PATENT DOCUMENTS

FR 2650176 A1 * 2/1991

OTHER PUBLICATIONS

GFM Ideas, LLC, website printout https://dialysisarmbands.com; Printed Mar. 2, 2021 and published at least as early as Mar. 18, 2020.

Lymphedema Products, LLC website printout, copyritght 2000-2021, https://www.lymphedemaproducts.com/products/compression-sleeves.html?.

*Primary Examiner* — Amy Vanatta

(74) *Attorney, Agent, or Firm* — Jeffrey S. Sokol

(57) ABSTRACT

The present invention is a fistula sleeve for covering and protecting a fistula on the inside of an arm. The sleeve grips the wrist and adjustably and snuggly fits around the wider contours of the arm without imparting pressure on the fistula. The sleeve partially opens to expose the fistula for dialysis and daily care. A narrower wrist region secures around the wrist. An elongated forearm region wraps around the forearm, and a smooth central region covers the fistula. The wrist and forearm regions are independently secured. Securement strips have semi-rigid backings that stiffen the side portions of the sleeve help secure and remove the sleeve with one hand, and form a spine to help maintain the alignment of the sleeve on the arm. A double layer of material is stitched together along its perimeter, while the inner layer is free to slide relative to the outer layer in the smooth central area that engages the fistula. The sleeve stretches laterally to grip and secure around the wrist, while allowing the forearm portion to snuggly fit around the contours of the forearm and accommodate the fistula in a non-pressure generating manner.

21 Claims, 11 Drawing Sheets

(58) Field of Classification Search
CPC ..... A61F 5/013; A61F 2013/00187; A61F 2007/0029; A61M 2209/088; Y10S 2/91; Y10S 2/911; Y10S 2/917; A63B 71/148; A63B 71/14
USPC ..... 2/16, 59, 275
See application file for complete search history.

(56) References Cited

U.S. PATENT DOCUMENTS 4,374,439 A * 2/1983 Norman ..... A41D 13/088 2/910
4,854,309 A * 8/1989 Elsey ..... A61F 5/0118 602/21
4,951,317 A 8/1990 Gray et al.
4,977,622 A * 12/1990 Schley ..... A41D 13/12 2/125
5,023,953 A 6/1991 Bettcher
5,070,541 A * 12/1991 Goss ..... A41D 13/08 2/910
5,188,608 A 2/1993 Fritts
5,370,606 A * 12/1994 Martel ..... A61F 5/0118 2/161.1
5,395,399 A * 3/1995 Rosenwald ..... A61F 5/0104 607/108
5,728,059 A * 3/1998 Wiesemann ..... A61F 5/0118 128/878
6,254,554 B1 7/2001 Turtzo
6,845,514 B1 * 1/2005 Yao ..... A61F 13/104 128/878
6,892,733 B2 5/2005 Clinton
7,621,882 B2 * 11/2009 Phillips ..... A61F 5/0104 602/23
8,689,712 B2 * 4/2014 Maramotti ..... D06H 5/003 112/475.17
8,790,323 B1 7/2014 Gilyanna
9,993,621 B2 6/2018 Bouchard
10,149,964 B2 12/2018 Fitzgerald
10,179,062 B2 1/2019 Putman
10,918,836 B2 * 2/2021 Jutras ..... A61M 25/02
2008/0208130 A1 * 8/2008 Furman ..... A61M 25/02 604/164.08
2018/0250463 A1 * 9/2018 Olivarez ..... A61B 5/6824

* cited by examiner

FISTULA SLEEVE

TECHNICAL FIELD OF THE INVENTION

This invention relates to a fistula sleeve with a wrist gripping region that secures to the wrist of a person and a forearm covering region that adjustably and snuggly fits around the forearm to protect a fistula in a non-pressure generating manner, with the forearm covering region being separately openable to expose the fistula during dialysis and daily care.

BACKGROUND OF THE INVENTION

When feasible, an arteriovenous fistula is recommended for hemodialysis vascular access, such as for kidney dialysis. The fistula is surgically constructed in the arm of the patient by joining a vein and an artery. The fistula has a length of about six inches and runs generally longitudinally along the length of the arm or limb. The fistula is constructed just beneath the skin so that it is readily accessible during dialysis. The increased pressure on the walls of the vein causes it to enlarge, which creates an elongated bulge or series of bulges along the arm. The degree of bulging increases over time and can become quite pronounced, often projecting out a half inch or more from the natural contours of the arm, which renders the fistula susceptible to injury. The fistula is commonly formed in the forearm, but can also be formed in the upper arm. The fistula is located on the inside of the arm, about midway between the wrist and elbow or midway between the elbow and shoulder. Locating the fistula on the inside of the non-dominant arm of the person helps protect it from injury.

During dialysis, a first needle is inserted via cannulation into a first tract or port in the fistula to draw blood from the patient, which is sent to the dialysis machine for filtration. A second needle is inserted into a second tract in the fistula to return filtered blood to the patient. The tracts are spaced apart, and are typically located near the opposite ends of the fistula. The frequency of dialysis varies from patient to patient, but is often several times a week or even daily. Dialysis needles are typically larger in diameter for increased blood flow to reduce the time needed for dialysis. While a typical I.V. needle is relatively small in diameter, a cannula or catheter needle for dialysis has a large diameter, usually about 14 gauge to 18 gauge (outer diameter 2.1 and 1.2 mm, respectively). Bandages are applied over the fistula after dialysis to stop bleeding.

Fistulas require care to prevent injury and infection. The fistula should be washed with an antibacterial soap every day. Applying pressure to the fistula should be avoided, particularly prolonged pressure, which can restrict or cut off blood flow through the fistula and damage the fistula. The bulging nature of the fistula increases the chances of injury due to snagging on an object and tearing open, cuts, punctures, bumps and abrasions, each of which can damage to the fistula and cause infection, uncontrolled bleeding and even death.

The forearm and upper arm have elongated bone structures that provide rigidity. The bone structure runs more along the outside of the forearm and upper arm, with softer tissues being on the inside of the arm. The shoulder, elbow, wrist, and finger joints allow a high degree of bending and flexing movement. Muscles, tendons and ligaments secured to or between the joints provide the means for this movement. Veins and arteries pass through arm to supply blood throughout the arm. A layer of skin covers and protects the arm. Each of these components contributes to the shape and contours of the arm. The hand has a circumference that is typically wider than that of the wrist. The circumference of the forearm generally increases as it progresses from the wrist to the elbow. The circumference of the upper arm typically increases as it progresses from the elbow to the shoulder. The skinniest part of the forearm or the portion with the least circumference is typically proximal the wrist. The skinniest part of the upper arm is typically proximal the elbow. Applying external pressure to the arm compresses the shape and contours of the skin, muscle, ligament, vein and artery tissues, as well as any fistula.

Protecting a fistula from injury and infection is important and encouraged. Activities that can damage the fistula such as contact sports and weight lifting should be avoided. Still, the location of the fistula on the inside of the forearm and its bulging nature renders it prone to inadvertent snagging, tearing, cutting, puncturing or abrasive engagement with a myriad of common items, such as belt buckles, zippers, buttons, fingernails, toys, tools, kitchen ware, dinner utensils, corners and edges of furniture, splintered benches, chipping paint, rusted stair railings, etc. Covering the fistula can help minimize possible injury and infection due to our daily interaction with these common items.

Conventional garments and accessories do not provide adequate protection or are simply inappropriate to cover and protect a fistula. The garment or accessory should not exert any significant pressure on the fistula, easily secure to the arm and allow for bandages. They should also provide a smooth, snug fit over the varying contours of the arm and fistula without binding, kinking or folding, and should avoid rubbing against the fistula when being put on or taken off. While a long sleeve shirt may cover the fistula, the single, thin layer of cloth and its generally baggy fit provides ineffective protection from snags, cuts, punctures or abrasions, and little help holding bandages in place. Shirt sleeves also hide the fistula, and because they are so commonly worn by the general population, they provide no indication that the person has a fistula. Emergency personnel that engage the person may not check for the fistula, and fail to take the necessary precautions needed to avoid serious or even fatal harm to the person.

Accessories such as athletic sweat bands, arm pads and compression sleeves are inappropriate to cover and protect a fistula. Sweat bands are generally worn over the wrist, and tend to slide down toward skinniest part of the wrist. Arm pads are worn over the forearm, elbow or upper arm when a person is playing or otherwise engaged in contact sports to help protect these areas from injury. These bulky items are pulled over the hand and onto the wrist, forearm, elbow or upper arm, and include one or more elastic bands to grip the arm and secure them in place. Putting them on and taking them off is a questionable practice given the rubbing and pressure they exert on the fistula. They are also awkward looking at best for daily wear. Compression sleeves are worn over larger parts of the arm and remain significantly stretched to apply pressure to support or stabilize the desired part of the arm. Compression sleeves are not intended for permanent use, and are removed after the person finishes their athletic activity. Compression sleeves are problematic in that they exert pressure on and restrict blood flow through the fistula. Providing a protective garment or covering that fits the contours of the arm, stays in place without creating pressure on the fistula, and allows ready access to the fistula for dialysis and daily care is problematic.

The present invention is intended to solve these and other problems.

BRIEF DESCRIPTION OF THE INVENTION

The present invention relates to a fistula sleeve for covering and protecting a fistula on the inside of an arm. The sleeve grips the wrist and adjustably and snuggly fits around the wider contours of the arm without imparting pressure on the fistula. The sleeve partially opens to expose the fistula for dialysis and daily care. A narrower wrist region secures around the wrist. An elongated forearm region wraps around the forearm, and a smooth central region covers the fistula. The wrist and forearm regions are independently secured. Securement strips have semi-rigid backings that stiffen the side portions of the sleeve help secure and remove the sleeve with one hand, and form a spine to help maintain the alignment of the sleeve on the arm. A double layer of material is stitched together along its perimeter, while the inner layer is free to slide relative to the outer layer in the smooth central area that engages the fistula. The sleeve stretches laterally to grip and secure around the wrist, while allowing the forearm portion to snuggly fit around the contours of the forearm and accommodate the fistula in a non-pressure generating manner.

When laid flat, the sleeve has a first side with a main securement strip. The main securement strip can extend continuously along the length of the sleeve or include a shorter offset segment near the front of the sleeve. The main securement strip has a semi-rigid backing secured to the bottom of the sleeve. The opposite side of the sleeve is divided into two distinct segments by a slot. The forward or wrist segment in front of the slot is shorter and has a wrist securement strip with a semi-rigid backing fixed to the top of the sleeve. The rearward or forearm segment to the rear of the slot has a forearm securement strip with a semi-rigid backing fixed to the top of the sleeve. The forward and rearward securement strips are offset. When fastened to an arm, the forward segment secures around the narrower wrist, and the rearward segment secures around the wider forearm. The rearward segment is selectively opened to expose the underside of the forearm and fistula during dialysis and daily care.

An advantage of the present fistula sleeve is that it fits snuggly around the contours of the forearm and over the fistula without exerting significant pressure on the fistula. While its shorter forward or joint region securely grips the wrist, the longer rearward or arm region is secured around the forearm to snuggly cover and protect the fistula while exerting minimal or no pressure on the fistula, even when bandages are in place. The wrist securement strip adjustably engages a forward portion of the main securement strip so that the amount of lateral wrap of the wrist region around the wrist securely grips the wrist to secure the sleeve to the arm. The main securement strip is now aligned along the longitudinal axis of the forearm. The forearm securement strip adjustably engages the main securement strip so that the amount of lateral wrap of the forearm region around the forearm snuggly engages the contour of the forearm and covers the fistula and any bandages.

Another advantage of the fistula sleeve is the large smooth area it provides to cover and protect fistula. The adjustability of the amount of lateral wrap via the securement strips and the lateral stretchability of the fabric allow the elongated fistula region to snuggly fit around the contours of the forearm and over the fistula without folding or kinking of the material and without generating significant pressure on the fistula. The stitching does not inhibit the stretchability of the fabric. The snuggly fitted smooth area provides a gradually slopping contour between the arm and the top of the fistula to help prevent or deflect snagging engagement of the abruptly protruding sides of the fistula with objects such as a zipper, belt buckle, edge of a table, chair or door, etc. Also, should an item snag on the upper layer of the sleeve, the lower layer of the sleeve is not snagged with it and remains in place to avoid injury. The large smooth area also remains in contact with the fistula even should some degree of lateral and longitudinal shifting of the sleeve occur during the course of daily wear.

A further advantage of the fistula sleeve is that it does not rub against or otherwise irritate the fistula when being put on or taken off. The sleeve wraps around the wrist and forearm to secure it in place. The sleeve is not pulled up over the hand and arm, and is not dragged over the widening contour of the forearm so that rubbing and pressure on the fistula is avoided. The fistula can be frequently uncovered for examination, cleaning, bandaging and dialysis while avoiding repeated rubbing irritation.

A still further advantage of the fistula sleeve is that it allows easy access to the fistula for dialysis and daily care without removing the sleeve. The forearm segment of the sleeve can be pulled back while the wrist segment remains fixed to the wrist. The fistula can be cleaned, dialysis needles inserted and removed, and bandages applied and removed by simply disengaging and opening the forearm segment. The wearer can also open the forearm segment to examine the fistula for injury or infection. The need to remove the sleeve and finding a safe, clean temporary place to place the sleeve is avoided.

A still further advantage of the fistula sleeve is that it is easily secured and removed with just one hand. The sleeve can be spread out to lay flat on a table or other convenient surface. The arm is placed against the smooth middle region, with the more rigid securement strips extending along the sides of the arm. The side of the sleeve with the main securement strip is then draped over the forearm. The wrist region is then stretched and secured in a gripping manner to hold the sleeve in place. The continuous and semi-rigid nature of the main securement strip helps maintain it against the outer side of the arm, which helps the person align the forearm flap and its elongated securement strip with the main strip. The longer forearm strip is then secured to the main strip to provide a smooth, snug fit over the varying contours of the arm and fistula. The smooth region of sleeve material flushly engages the fistula while exerting minimal to no pressure on the fistula, and without binding, folding or kinking. A practical and usable sleeve is provided to cover and protect the fistula, and prevent it from snagging, catching or rubbing on other objects.

A still further advantage of the fistula sleeve is that it maintains its smooth shape and alignment on the arm. The securement strips form a longitudinally straight semi-rigid spin along the length of the sleeve. The cross-sectional shape of the spine can be flat or rounded to flushly engage the flat upper surface or laterally rounded side surface of the forearm. The engagement of the sleeve with the like-shaped surface of the arm maintains the sleeve in alignment on the arm and helps prevent the sleeve from inadvertently rotating about the longitudinal axis of the arm. This prevents the spine from inadvertently rotating into engagement with the fistula on the inside or lower surface of the arm. The semi-rigid spine also prevents the fabric from kinking and folding, and the ends of the sleeve from rolling up, so that the central region of the sleeve smoothly engages the fistula. Irritation to the fistula due to kinks, folds and other disruptions in its smooth surface is avoided. The smooth central region covering the fistula helps prevent inadvertent snagging or catching on objects such as belt buckles, zippers, buttons, edges of tables, etc.

A still further advantage of the fistula sleeve is that its semi-rigid spine allows the wearer to easily manipulate the sleeve to adjust its position on the arm with just one hand. When the sleeve is worn, the wearer can grip the spine with his or her opposite hand to rotate the sleeve on the arm or pull the sleeve up or down the arm. Although the fabric forming the sleeve is highly flexible and floppy, which renders the fabric unwieldy should the sleeve need to be repositioned, the wearer can grip the spine with one hand to simultaneously rotate the entire length of the sleeve, or pull or push the sleeve up or down the arm. The stiffness of the spine allows the entire length of the sleeve to move in unison, which increases manageability when the wearer only has his or her other hand to manipulate the sleeve.

A still further advantage of the fistula sleeve is the protection it provides. The sleeve not only prevents snagging of the fistula on other objects, but is also cut, puncture and abrasion resistant, and provides a barrier to dirt and grime to help avoid infection. The multiple layers, thread count and stretchable nature of the fabric help prevent cuts and punctures. Items like belt buckles, zippers, keys, toys and utensils do not readily cut or puncture the material.

A still further advantage of the fistula sleeve is its durable, washable and reusable nature. The fabric of the sleeve is preferably made of polyester or nylon filament blended with spandex. The multilayer material is double stitched along its perimeter, and the securement strips are stitched in place. The fabric, stitching and securement strips are machine washable and dryable.

Other aspects and advantages of the invention will become apparent upon making reference to the specification, claims and drawings.

DESCRIPTION OF THE PREFERRED EMBODIMENTS

Figure 1:
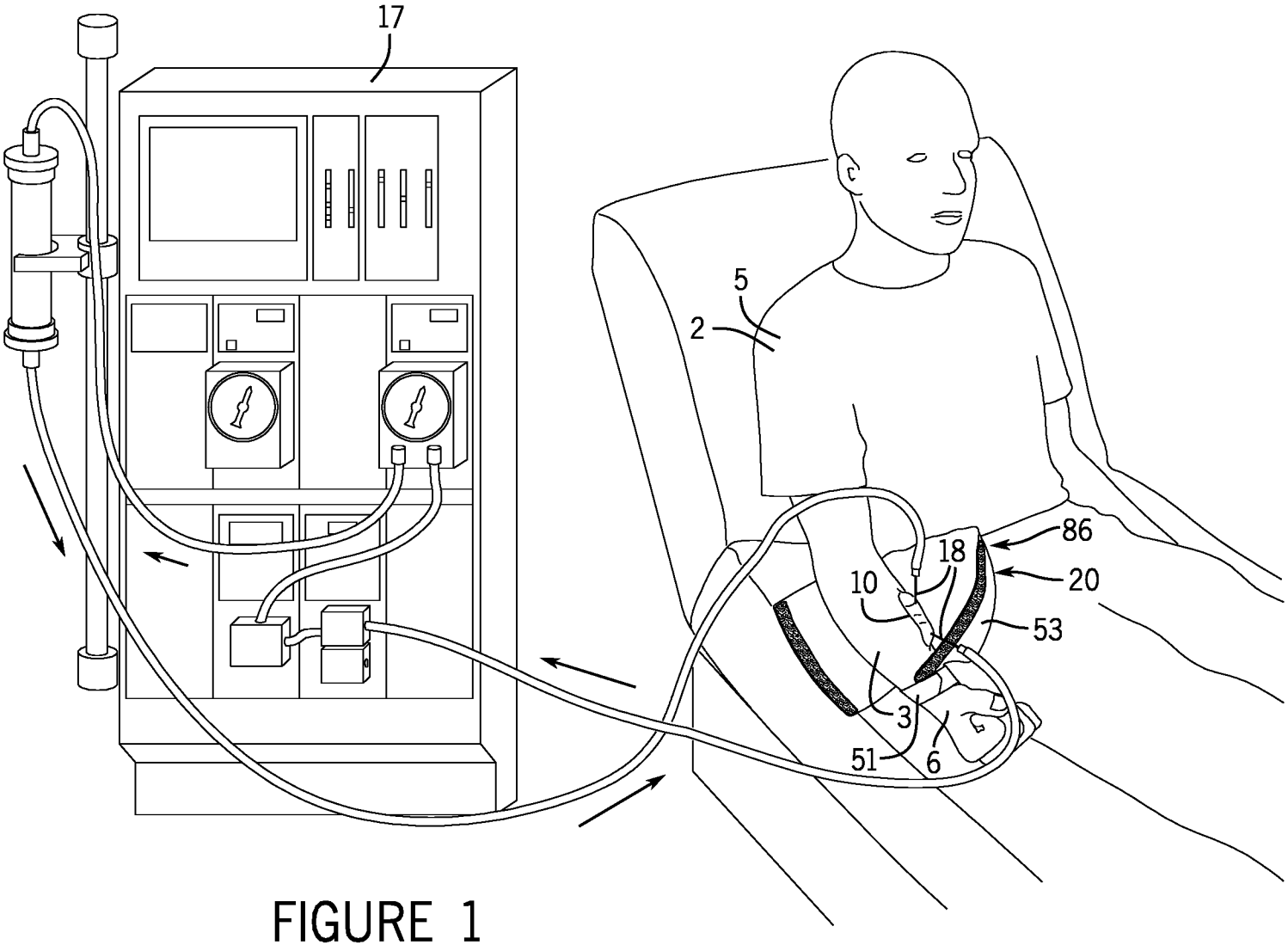
FIG. 1 is a perspective view showing a person undergoing dialysis with the fistula sleeve secured around the wrist of the person and partially opened to expose the fistula to insert the dialysis needles.

While this invention is susceptible of embodiment in many different forms, the drawings show and the specification describes in detail preferred embodiments of the invention. It should be understood that the drawings and specification are to be considered an exemplification of the principles of the invention. They are not intended to limit the broad aspects of the invention to the embodiments illustrated.

The human arm 2 includes a forearm 3, elbow 4, upper arm 5, wrist 6, hand 7, fingers and shoulder. A layer of skin 8 covers and protects the arm 2, and defines its natural surface contours 9. The elbow 4, wrist 6, finger and shoulder joints allow for bending and flexing movement. The forearm 3 and upper arm 5 have rigid bone structures that define their longitudinal axes. Muscles, tendons and ligaments secured to or between these joints allow the arm to bend and move. Veins and arteries pass through arm 2 to provide its blood supply.

The forearm 3 and upper arm 5 have inner 3*a*, 5*a*, outer 3*b*, 5*b* and side 3*c* surfaces. The outer or upper surface 3*b* of the forearm 3 forms a generally harder and flatter surface given its proximity to the bone structure, particularly relative to its softer and more rounded inner or under surface 3*a*. The side surface 3*c* of the forearm 3 is longitudinally straight and laterally rounded. The inside surface 3*a* of the forearm 3 is generally aligned between the elbow 4 and the palm of the hand 7. The inside surface 5*a* of the upper arm 5 is generally aligned between the elbow 4 and the pit of the shoulder. The circumference of the hand 7 is typically wider than that of the wrist 6. The circumference of the forearm 3 generally increases as it progresses from the wrist 6 to the elbow 4. The circumference of the upper arm 5 typically increases as it progresses from the elbow 4 to the shoulder. The skinniest part of the forearm 3, or part having the least circumference, is typically proximal the wrist 6. The skinniest part of the upper arm 5 is typically proximal the elbow 4.

A fistula 10 for kidney dialysis is commonly located on the inside surface 3*a* of the forearm 3, but can also be located on the inside surface 5*a* of the upper arm 5. The fistula 10 joins an artery and a vein to create access sites at its upper and lower ends. When in the forearm 3, the fistula 10 is located about midway between the wrist 6 and elbow 4. It is commonly between two and five inches in length, and has a longitudinal centerline 11 generally parallel to the longitudinal axis or length 3*d* of the forearm. The fistula 10 is constructed just beneath the skin 8 so that its access sites are readily accessible during dialysis. The increased pressure on the walls of the vein causes it to enlarge, which creates a generally linear, elongated bulge or series of bulges that are visible along the surface of the skin 8. The amount of bulging increases over time and can become quite pronounced, with the top 15 of the fistula often projecting out about a half inch or more from the natural contour 9 of the arm 2. This bulging creates an abrupt change in the natural contour 9 of the arm 2, with the sides 16 of the fistula 10 protruding at a high angular degree from the natural contour 9 of the arm 2. The abruptly bulging side surfaces 16 of the fistula 10 can snag or catch on other objects.

During dialysis, a first catheter needle 18 is inserted into one fistula access site to draw blood that is sent via tubing to a dialysis machine 17 and its filters. The filtered blood is then returned via alternate tubing to a second catheter needle 18 inserted into another fistula access site. When the needles 18 are removed after dialysis, one or more bandages 19 are applied over the access sites to absorb and stop bleeding, and to form a sterile barrier to prevent infection from entering the access sites. While the fistula 10 is shown and described as being on the inside 3*a* of the forearm 3, it should be understood that the fistula can also be located on the inside 5*a* of the upper arm 5, about midway between the elbow 4 and shoulder, and its centerline 11 is generally parallel to the longitudinal axis or length 3*d* of the upper arm.

Figure 11:
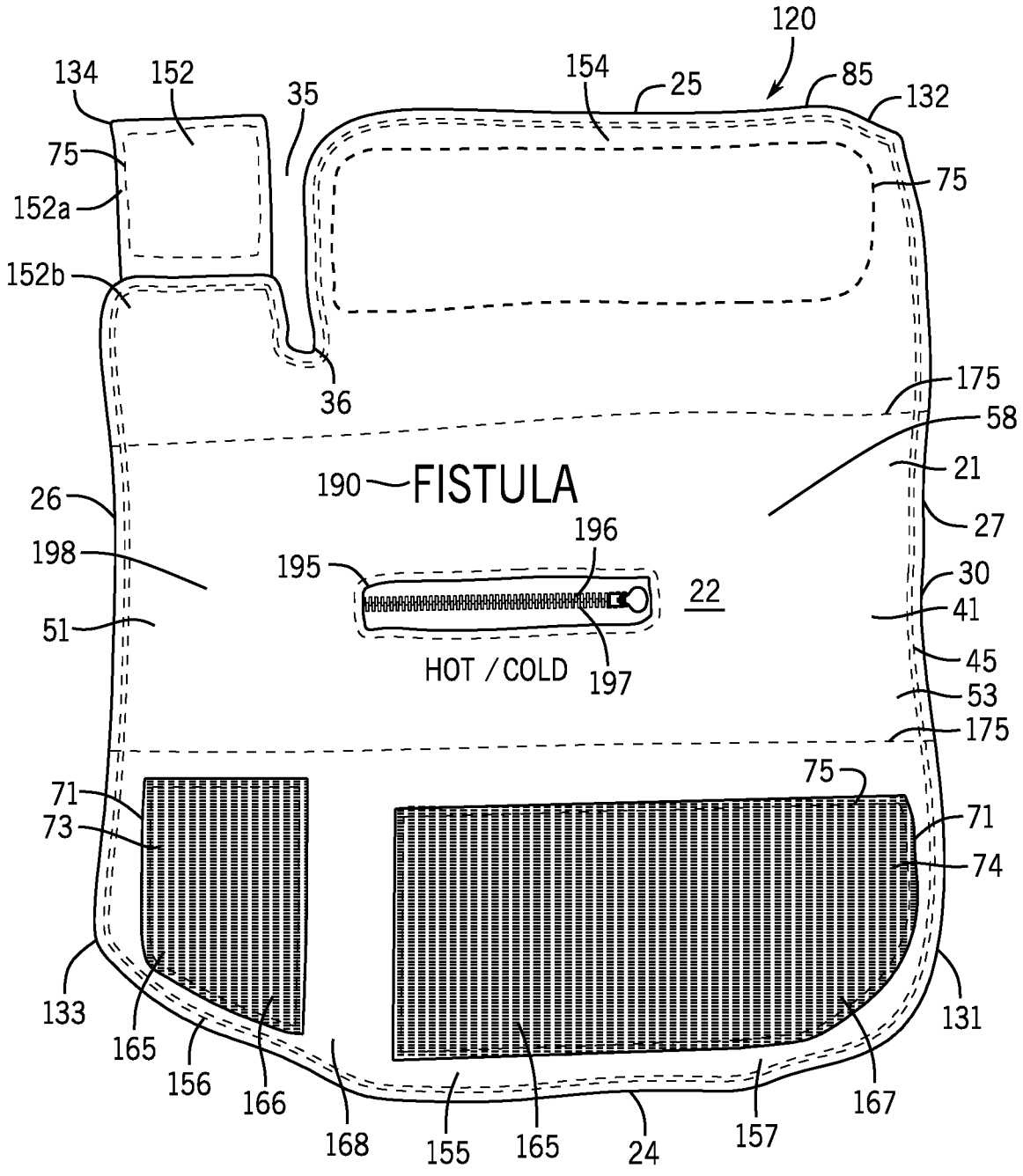
FIG. 11 is a top view of a second embodiment of the fistula sleeve with the main securement strip formed by a shorter forward portion and a longer rearward portion, the wrist securement flap including a band or strap onto which the wrist securement strip is fixed, and showing the outside surface with a fistula warning message and a zipped access opening of a pocket between the first and second fabric layers.
Figure 12:
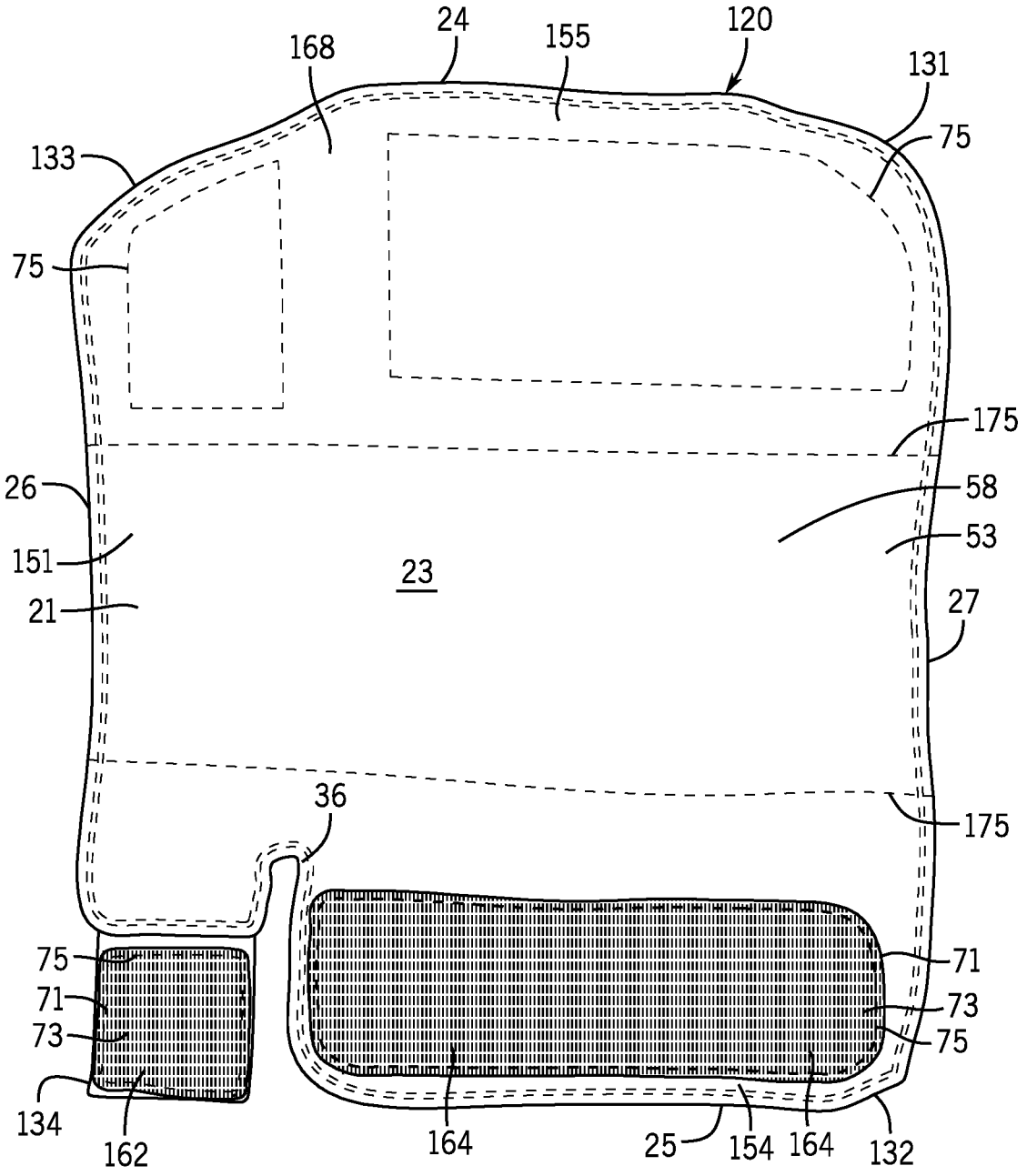
FIG. 12 is a bottom view of the second embodiment of the fistula sleeve.

The present invention generally relates to a fistula sleeve that is generally shown as reference number 20 in FIGS. 1-10. A second embodiment of the fistula sleeve 120 is shown in FIGS. 11-12 as discussed below. When laid flat as in FIGS. 4-5, the fistula sleeve 20 is generally rectangular or square in shape, with a main body 21 having upper and lower surfaces 22 and 23, first and second longitudinal sides 24 and 25, and front and rear lateral ends 26 and 27. The sleeve 20 has a perimeter 30 with three slightly rounded ninety degree angle (90°) corners 31-33 and a fourth corner 34 located at the front 26 of the sleeve that is at a sheered angle of about one hundred and twenty degrees (120°). One side 24 of the sleeve 20 spans in an uninterrupted continuous manner from the front end 26 to the rear end 27. The other side 25 of the sleeve 20 is interrupted by a slot or notch 35. The slot 35 is generally linear and extends laterally into the sleeve 20 from its longitudinal side 25 to its inner end 36. The slot 35 is located about an inch or two from front corner 34, and has a lateral length or depth of about two to three inches. The depth of the slot 35 and its distance from front corner 34 depend on the size of the sleeve 20 (e.g., small, medium, large, x-large). The linear slot 35 defines a slot continuation line 37 extending across the remaining lateral width of the sleeve 20. The sleeve 20 has a longitudinal centerline 39 that aligns with the longitudinal axis or length 11 of the forearm 3. Depending on the size of the sleeve 20, it has a lateral width of about twelve to fourteen and one-half inches (12" to 14½"), and a longitudinal length of about six to eleven inches (6" to 11"). The sleeve 20 has a thickness of about ⅛ to ¼ inch.

The fistula sleeve 20 is formed by a main body 21 of material or fabric 40 that preferably includes two separate, like shaped layers of material or fabric 41 and 42. The fabric 40 and each of its layers 41 and 42 has a floppy, highly flexible nature that offers little resistance to folding, kinking, twisting and the like, even under its own weight, and tends to conform to the surface upon which they are placed. The fabric 40-42 is preferably about 80% to 97% polyester or nylon filament, and 3% to 20% spandex, such as Cheeta Microflex by Athleisure, 4Way Stretch by Techno Scuba and Cosplay 4-Way Ultrapreme by Yaya Han. The fabric 40-42 is stretchable, particularly in the lateral direction that wraps around the arm 2. While a twelve inch longitudinal span of the material 40-42 readily stretches about an additional inch, an eight inch lateral span of the material readily stretches about an additional two inches. Each layer of fabric 41 and 42 has a thickness of about 1/32 inch.

The top fabric layer 41 is placed on the bottom layer 42, and their outer edges 24-27 are aligned. The outer edges 24-27 are hemmed 44 together to form the main body 21 of the sleeve 20. For the hemming, about ⅜ inch of material from each layer 41 and 42 is folded inward so that four layers of material are stitched together along the perimeter 30. With regard to FIG. 10, the fabric layers 41 and 42 are first stitched together with their inside surfaces 43 facing out. After making these initial stitches (not shown), the fabric layers 41 and 42 are inverted so that the inner fabric surfaces 43 face inward, and the top and bottom sleeve surfaces 22 and 23 face outward. The hem stitching 45 around the perimeter 30 is made to hold the folded inside edges of the aligned fabric layers 41 and 42 in place, and keep the hemmed perimeter 30 lying flat, so the hemmed perimeter does not roll or move around.

The slot or notch 35 is formed by making a cut in the aligned fabric layers 41 and 42. The cut or slot 35 extends laterally inwardly from the longitudinal side 25 of the sleeve to its inner end 36. The slot 35 is hemmed 44 by folding the outer ⅜ inch of the material layers inward so that four layers of material are stitched together. The slot 35 has a width of about ½ to ¾ inch. The hemming 45 around the perimeter 30 of the main body 21 and the hemming 45 around the slot 35 include a double row of parallel stitching. The outer row of stitching 45 is spaced about ⅛ inch from the outer edge of the perimeter 30 and slot 35. The inner row of stitching 45 is spaced about ⅛ inch from the first row of stitching. While the layers 41 and 42 are fixed by stitching 45 along the perimeter 30 and slot 35, the inner surfaces 43 of the fabric layers 41 and 42 are free to slide relative to each other in the central region of the sleeve 20.

The fistula sleeve 20 has several regions 51, 53 and 58 and flaps 52, 54 and 55. A first or wrist gripping region 51 is located along the forward or wrist end 25 of the sleeve. The wrist gripping region 51 extends from one side 24 of the sleeve to the other 25, and extends from the slot 35 and its continuation line 37 to the forward or wrist end 26. The wrist gripping region 51 includes a wrist securement flap 52 along the slot side 25 that is directly between the slot 35 and the wrist end 26. A second or forearm covering region 53 extends from one side 24 of the sleeve to the other 25, and extends from the slot 35 and its continuation line 37 to the rear or forearm end 27. The forearm covering region 53 includes a forearm securement flap 54 along the slot side 25 that is directly between the slot 35 and the rear end 27. Wrist and forearm flaps 52 and 54 are generally parallel. They are either linearly aligned or the wrist flap 52 is inwardly recessed about one inch from forearm flap 54 so that an offset 59 of about one half to one inch (½"-1") exists between them. The amount of offset 59 increases with the size of the sleeve. (e.g., small, medium, large). A main securement flap 55 is located on the opposite side 24 from the wrist and forearm flaps 52 and 54. The main securement flap 55 extends from one end 26 of the sleeve to the other 27, and extends inwardly from the perimeter 30 of side 24 for a distance of about two inches. The main flap 55 has a lower or wrist portion 56 and an upper or forearm portion 57. The forearm covering region 53 forms a central fistula covering region 58 located between the forearm flap 54 and main flap 55, and extends between the slot continuation line 37 and the perimeter 30 of forearm end 27.

Securement strips 60 are fixed to the flaps 52, 54 and 55. The securement strips or segments 60 are preferably hook and loop type securement strips, such as Velcro® strips. The strips or segments 60 include a first felt or wrist securement strip 62, a second felt or forearm securement strip 64 and third hooking or main securement strip 65. The main strip 65 is an integral piece that defines a sorter forward portion 66 and an elongated rearward portion 67. While the floppy fabric 40 and its layers 41 and 42 do not retain their shape under their own weight, the securement strips 62, 64 and 65 do. While the central portion 58 of the sleeve 20 remains floppy, the flaps 52, 54 and 55 are stiffened by the securement strips 62, 64 and 65, particularly in combination with the adjacent perimeter hemming 45 stitched along the outer sides and ends of the strips.

Each strip 62, 64 and 65 has a semi-rigid backing layer 71. The plastic backing layer 71 has memory and tend to retain its flat shape when the sleeve 20 is being handled. The backing layers 71 resist planar twisting, particularly when held against a reasonably solid surface such as the upper 3*b* or inner side 3*c* surfaces of the forearm 3, but do flex and bend laterally to conform to the rounded cross sectional shape and contours 9 of an arm 2 when pressed or held snuggly against the arm. The main securement strip 65 facilitates the wearer's ability to secure the sleeve 20 to his or her arm 2. The main strip 65 causes the upper and lower portions 56 and 57 of the main flap 55 to move in unison. When one portion 56 or 57 of the main flap 55 is brought around the arm 2, the other portion 56 or 57 follows, which improves and simplifies the wearer's ability to secure the sleeve 20 to his or her arm 2 using only his or her opposite hand. The corners of the semi-rigid backing layers 71 are rounded to remove any sharp points that can injure the fistula 10. No securement strips 60 are fixed to the central region 58 so that the inside surface 23 of the sleeve 20 remains smooth throughout this region.

Each felt securement strip 62 and 64 has a felt layer 72 that is glued, adhered or otherwise uniformly secured to the upper surface of its backing layer 71. The felt layer 72 forms a plurality of loops 73 that project outwardly from the backing layer 71 a substantially uniform nominal distance of about ⅛ inch. The backing 71 of the hooking securement strip 65 has a plurality of uniformly disbursed and evenly spaced thin hooks 74 that project outwardly from the backing layer a substantially uniform nominal distance of about 1/16 inch. When the loops 73 and hooks 74 are brought together the hooks intermesh with and attach to the loops so that the felt strips 62 and 64 and hooking strips 65 are held in a relatively secure manner. When the felt strips 62 or 64 are forcibly pulled away from the hooking strips 65 with sufficient force, the curled ends of the thin plastic hooks 74 straighten and release from the loops 73 so that the strips detach.

The wrist securement strip 62 is sewn 75 or otherwise fixedly secured to the lower or inner surface 23 of the wrist flap 52. The stitching 75 traverses around the perimeter of the strip 62 and passes through both fabric layers 41 and 42 to fixedly join the strip and layers together. The wrist strip 62 has a generally rectangular or trapezoidal shape that fits within the longer and wider but similarly shaped wrist flap 52. The wrist strip 62 has a lateral width of about one to two inches depending on the size of the sleeve, and spans longitudinally from just inside the hemmed perimeter 30 of the wrist end 26 to just inside the hemmed perimeter of slot 35. The backing 71 of the wrist strip 62 and its hemmed perimeter 30 give the wrist flap 52 a degree of rigidity to help maintain the flap in a semi-rigid and flat shape, and which helps a person grip the flap 52 and secure its securement strip 62 to the forward portion 66 of the main securement strip 65.

The forearm securement strip 64 is sewn 75 or otherwise fixedly secured to the lower or inner surface 23 of the forearm flap 54. The stitching 75 traverses around the perimeter of the strip 64 and passes through both fabric layers 41 and 42 to fixedly join the strip and layers together. The forearm strip 64 has a generally rectangular shape that fits within the longer and wider but similarly shaped forearm flap 54. The forearm strip 64 has a lateral width of about one to two inches depending on the size of the sleeve (e.g., small, medium, large), and spans longitudinally from just inside the hemmed perimeter 30 of forearm end 27 to just inside the hemmed perimeter of slot 35. The backing 71 of the forearm strip 64 gives the flap 54 a degree of rigidity to help maintain the flap in a semi-rigid and flat shape, and which helps a person grip the flap 54 and secure its securement strip 64 to the rearward portion 67 of the main securement strip 65.

The main securement strip 65 is sewn 75 or otherwise fixedly secured to the upper or outer surface 22 of the main or side flap 55. The stitching 75 traverses around the perimeter of the strip 65 and passes through both fabric layers 41 and 42 to fixedly join the strip and layers together. The strip 65 spans almost the entire length of the sleeve 20, or from just inside the hemmed perimeter 30 of the wrist end 26 to just inside the hemmed perimeter of the forearm end 27. The main strip 65 has a lateral width of between about one half and three inches, and preferably about two inches. The length of the main strip 65 is greater than the combined lengths of the wrist and forearm strips 62 and 64. The backing 71 of the strips 62, 64 and 65 gives the flaps 52, 54 and 55 a degree of rigidity to help maintain their semi-rigid and relatively flat shapes, so that the floppy nature of the flexible sleeve fabric 40 does not become unmanageable when a person is securing the sleeve 20 to his or her arm, even when using just the one hand of his or her other arm. While much of the main body 21 of the sleeve 20 is free to stretch laterally and longitudinally as discussed above, the semi-rigid strips 62, 64 and 65 that are fixed by stitching 75 prevent the underlying portions of the flaps 52, 54 and 55 from stretching. When the main flap 55 is placed over the outer side 3*b* of the forearm 3, a single finger pressing the flap 55 against the outer side of the arm maintains the flap 55 in a relatively flat shape along the forearm.

Figure 2:
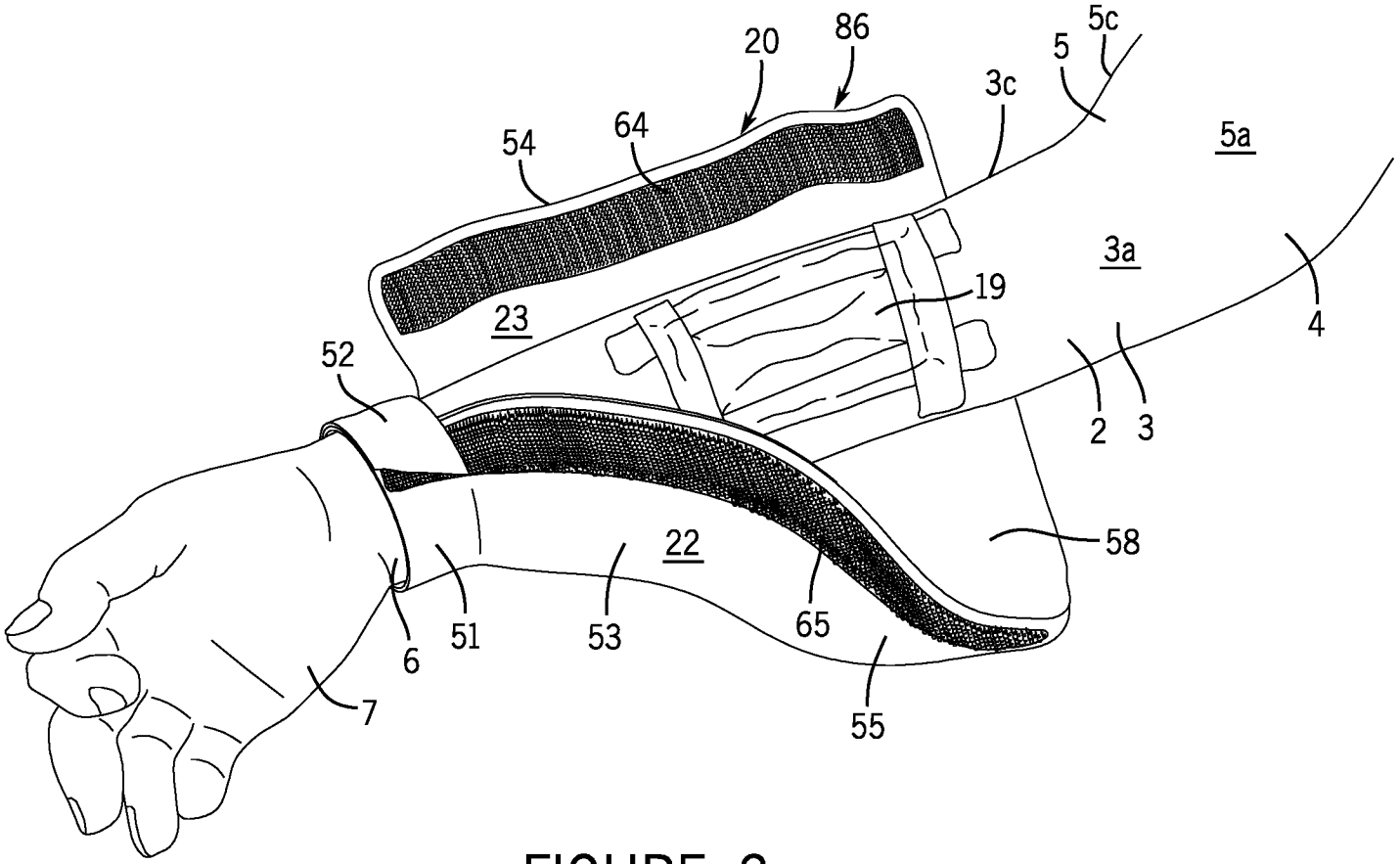
FIG. 2 is a perspective view showing the fistula covered by a bandage after dialysis with the sleeve secured around the wrist of the person and the sleeve partially opened.
Figure 3:
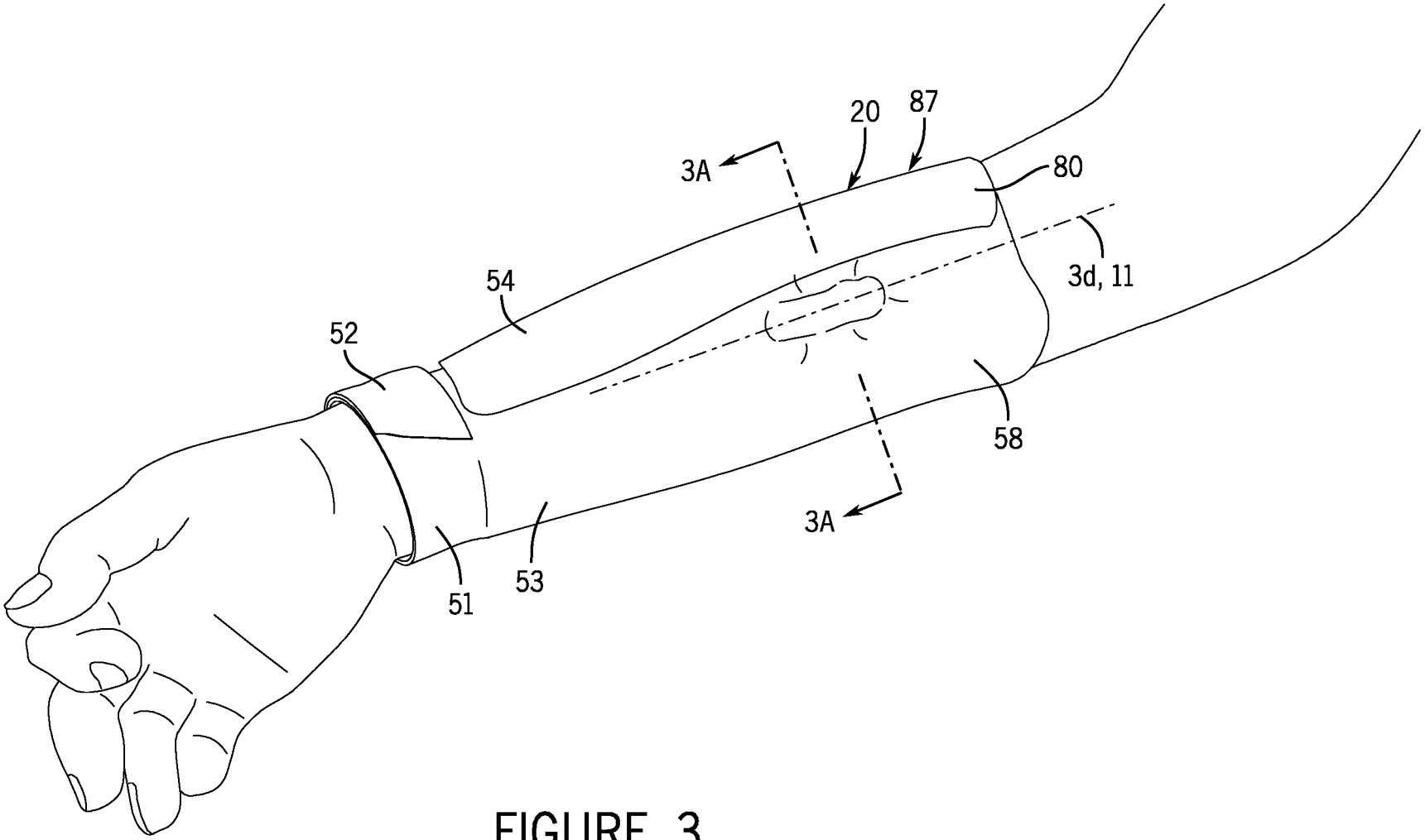
FIG. 3 is a perspective view showing the fistula sleeve in its fully secured or worn position to snuggly cover the fistula.

The fistula sleeve 20 can be laid flat in a fully opened position 85 (FIGS. 4 and 5), secured to the arm 2 in a partially opened position 86 (FIGS. 1 and 2) and worn in a fully secured position 87 as in FIG. 3. When fully opened 85, the sleeve 20 generally conforms to the shape of its supporting surface, such as when laying flat on a table. When the sleeve 20 is secured in the partially open position 86, the wrist flap 52 lays flat against and is secured to the wrist portion 56 of the main flap 55 via wrist strip 62 and the wrist portion 66 of main strip 65. The wrist region 51 wraps around the wrist 6, with the amount of wrap being adjustable to set the degree of gripping force or action. The arm flap 54 is not secured to the main flap 55 and can be pulled back or otherwise opened 86 to expose the fistula 10, such as during dialysis, or to clean or apply a bandage 19 over the fistula 10.

Figure 3A:
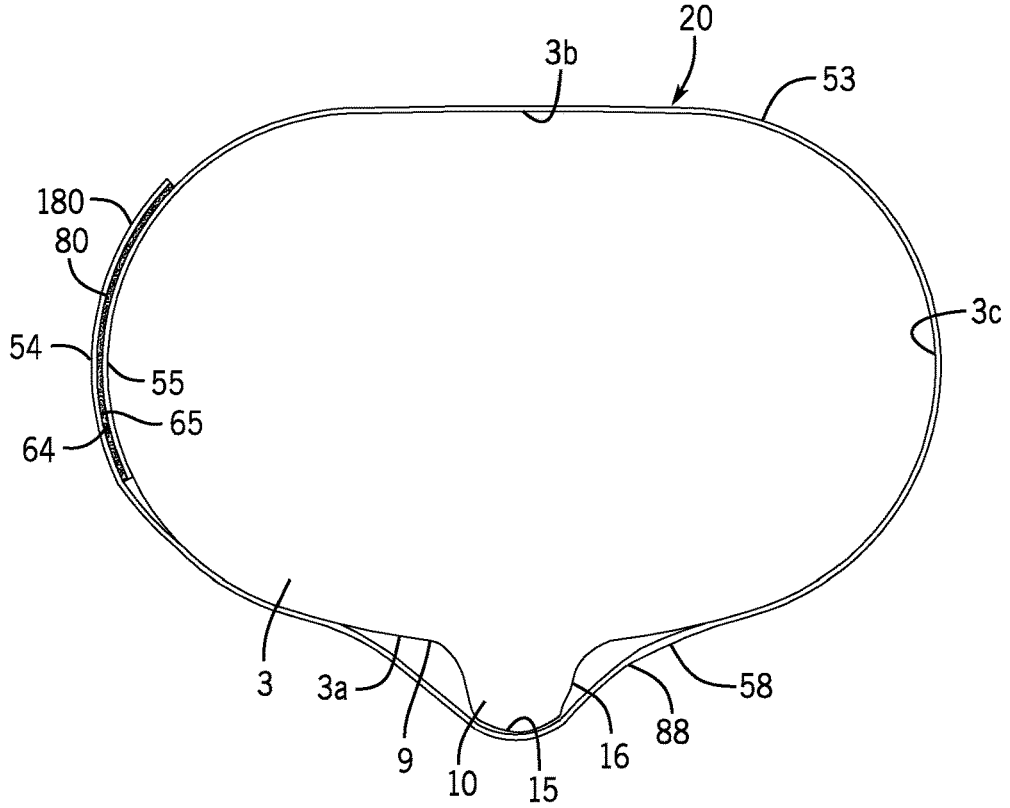
FIG. 3A is a sectional view of FIG. 3 showing the sleeve forming a smoothly contoured surface protecting the fistula from a side impacts or snagging on an object with the securement strips and spine conforming to the rounded lateral shape of the rounded side surface of the forearm.
Figure 3B:
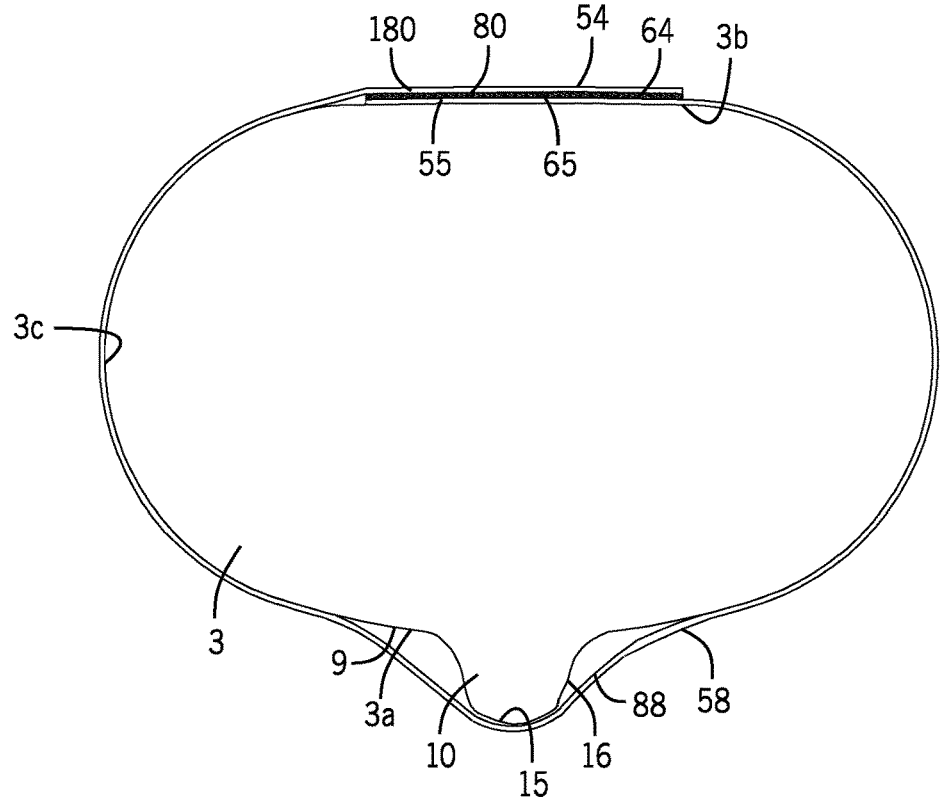
FIG. 3B is a side sectional view of FIG. 3 showing the sleeve forming a smoothly contoured surface protecting the fistula from a side impacts or snagging on an object with the securement strips and spine conforming to the flat lateral shape of the generally flat upper surface of the forearm.
Figure 4:
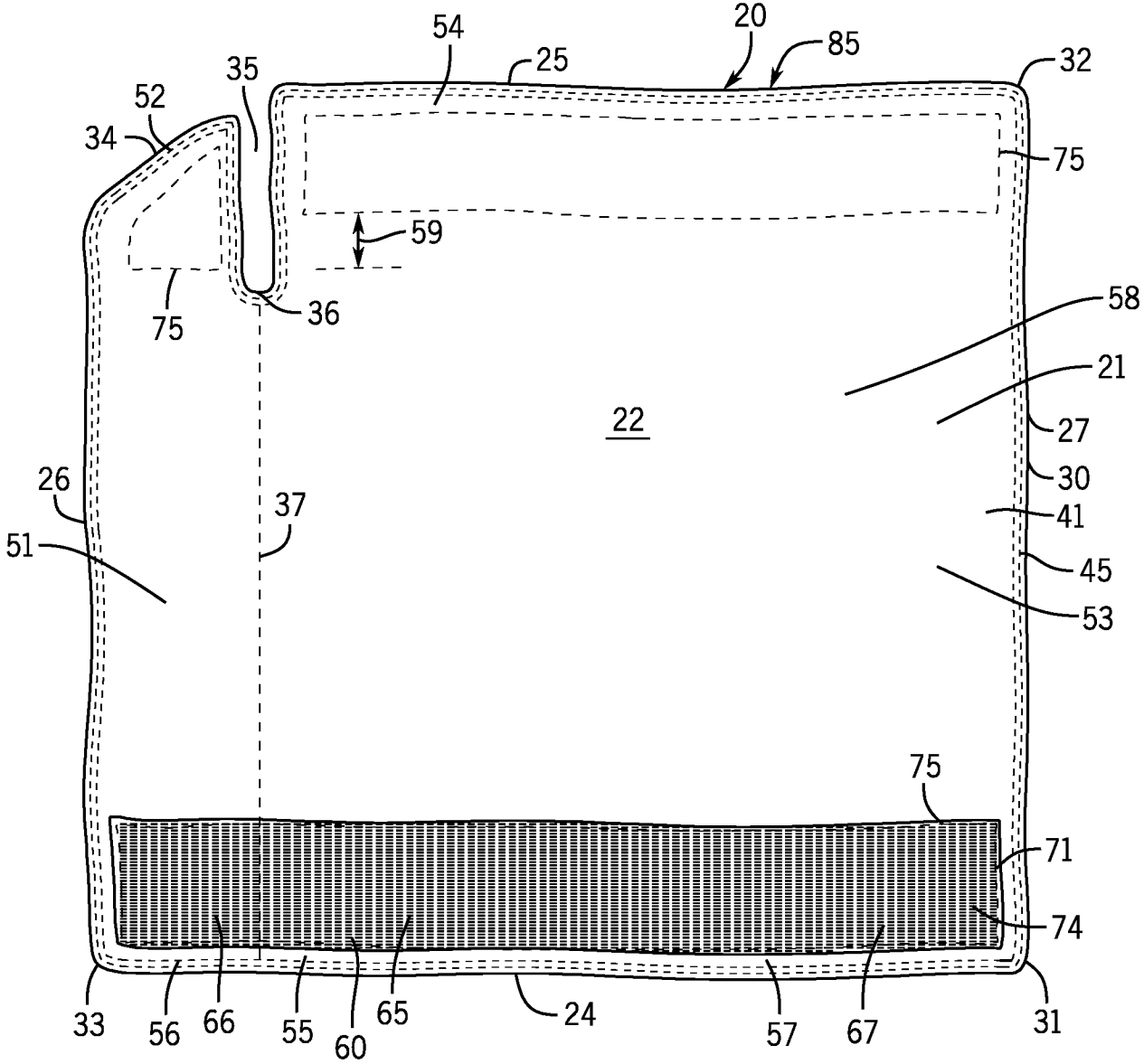
FIG. 4 is a top or outside view of the fistula sleeve.

When worn and in its fully secured or closed position 87 as in FIG. 3, the wrist flap 52 and arm flap 54 are secured to the upper and lower portion 56 and 57 of the main flap 55, respectively. The wrist flap 52 lays flat against and is secured to the wrist portion 56 of the main flap 55 via wrist strip 62 and the wrist portion 66 of main strip 65, and the forearm flap 54 lays flat against and is secured to the forearm portion 57 of the main flap via forearm strip 64 and the forearm portion 67 of the main strip. The spine 80 is longitudinally aligned along the length of the forearm 3, and the sleeve 20 is positioned so that the central region 58 covers the fistula 10. The smooth inwardly facing surface 23 of the inner fabric layer 42 engages the forearm 3 and fistula 10. The portion of the central region 58 surrounding the fistula 10 forms a gradual sloping contour 88 between the natural contour 9 of the forearm 3 and the top surface 15 of the fistula 10 as shown in FIG. 3A. This gradual sloping contour 88 protects the abruptly protruding side surfaces 16 of the fistula 10 from snagging or catching on an object such as a belt buckle, or the edge of a table, chair or door, etc. Depending on the lateral orientation of the sleeve 20 on the forearm 3, the semi-rigid spine 80 either laterally conforms to the curved side surface 3*c* of the forearm as in FIG. 3A or the flat upper surface 3*b* of the forearm as in FIG. 3B. In this way, the spine 80 laterally conforms to the lateral or cross sectional shape of the forearm 3 along the longitudinal length of the forearm.

The fit of the sleeve 20, which includes tightness of the sleeve around the wrist 6 and the snugness of the sleeve around the forearm 3, is controlled in a laterally adjustable manner by the person wearing the sleeve. The size of the sleeve 20 (e.g., large, medium, small) is selected so that the wrist and forearm securement strips 62 and 64 overlap with main securement strip 65 when the sleeve 20 is wrapped around the wrist 6 and forearm 3. The lateral widths of the wrist and main securement strips 62 and 65 allow the wearer to laterally adjust the amount of wrap of the of the wrist region 51 around the wrist 6, which in combination with the amount of lateral stretch of the fabric 40 in the wrist region, allows the wearer to adjustably increase or decrease the amount of grip action of the wrist region on the wrist. Similarly, the lateral widths of the forearm and main securement strips 64 and 65 allow the wearer to independently laterally adjust the amount of wrap of the of the forearm region 53 around the forearm 3, which in combination with the amount of lateral stretch of the fabric 40 in the forearm region, allows the wearer to adjustably increase or decrease the amount of snugging action of the forearm region on the forearm.

When worn, the joined securement strips 62, 64 and 65 form a semi-rigid spine 80 extending longitudinally down the length of the sleeve 20, and is linearly aligned with the longitudinal axis 3*d* of the forearm 3. The spine 80 is positioned on the longitudinally straight and relatively flat upper surface 3*b* of the forearm 3 or the longitudinally straight and laterally rounded side surface 3*c* of the forearm 3 so that it does not engage the fistula 10. When aligned longitudinally on the flat upper forearm surface 3*b* or its laterally rounded side surface 3*c*, the straight semi-rigid spine 80 helps keep the sleeve 20 from rotating on the forearm 3. The cross sectional shape of the semi-rigid spine 80 can be flat to conform to the flat cross sectional shape of the forearm upper surface 3*b*, or its cross sectional shape can be rounded to conform to the rounded cross sectional shape of the forearm side surface 3*c*.

By conforming to the longitudinally straight and the flat or rounded cross sectional shape of the forearm 3, the semi-rigid spine 80 helps maintain the alignment of the sleeve on the forearm and keep the sleeve 20 from rotating so that the smooth region 58 remains over the fistula 10. The semi-rigid spine 80 also prevents the floppy fabric 41 and 42 from kinking or folding and prevents the ends 26 and 27 of the sleeve 20 from rolling up, so that the central region 58 of the sleeve remains smooth. The semi-rigid spine 80 can be gripped with just one hand to rotate the sleeve 20 on the forearm 3, such as to rotate it into a comfortable desired position with the central region 58 covering the fistula 10, or to rotate it to disengage the strips 62, 64 and 65 so that pulling forces are directed away from the fistula.

A second embodiment of the fistula sleeve 120 is shown in FIGS. 11 and 12. This sleeve 120 has a main body 121 with three significantly rounded corners 131-133. Again, one side 24 spans in an uninterrupted continuous manner from the front end 26 to the rear end 27, while the opposite side 25 is interrupted by the slot 35. The fourth corner 134 is not rounded and is defined by a modified wrist flap 152. The wrist flap 152 includes a thin sidewardly 25 extending band 152*a* of stretchable material. The fabric 41 and 42 forming the flap 152 at its sideward end 152*b* is shortened, and the band 152*a* is fixed by hem stitching 45 to that sideward end so that the flap 152 includes both an inner fabric portion and an outer band portion. Two parallel rows of stitching 175 define the inward edges of the flaps 152, 154 and 155, and the outer side edges of the central area 158. The wrist and arm flaps 152 and 154 extend inwardly from their side 25 a distance of about four inches. The main flap 155 extends from one end 26 of the sleeve to the other 27, and also extends inwardly from its side 24 a distance of about four inches.

The main securement strip is a multi-piece strip 165 with a shorter forward portion 166 and a separate longer rearward portion 167. While the fabric layers 41 and 42 forming the main flap 155 extend continuously from one end 26 to the other 27, a gap 68 of about one inch separates the forward and rearward portions 166 and 167. Yet, even with this gap 68, the wrist and forearm portions 56 and 57 of the main flap 155 move in unison, such as when securing the sleeve 120 to the forearm 3. When one portion 56 or 57 of the main flap is brought around the arm 2, the other portion 57 or 56 follows, which simplifies and facilitates the wearer's ability to secure the sleeve 20 to his or her arm 2 while using just the hand of his or her opposite arm.

The separate portions 166 and 167 of the securement strip 180 are perpendicular. The shorter forward strip portion 166 is positioned laterally and is parallel to the wrist end 26 of the sleeve 120. The shorter strip portion 166 has length of about three and a half inches and a width of about two inches. One end of the forward strip portion 166 is slanted or rounded to accommodate the rounded corner 133 of the sleeve 20. The longer rearward strip portion 167 is positioned longitudinally and is parallel to the side 24 of the sleeve 120. The longer strip portion 167 has a length of about seven inches and a width of about three inches. One corner of the rearward strip portion 167 is rounded to accommodate the rounded corner 131 of the sleeve 20.

The sleeve 120 has a medical warning symbol or message 190 such as the word "fistula" on its outer surface 22 to warn emergency personnel and others, that the sleeve 120 is covering an easily injured fistula extremity. This sleeve 120 also has a pocket 195 formed into the central region 158. The optional pocket 195 has an access opening 196 formed by a soft, flexible plastic zipper 197 or other suitable closure mechanism leading to an internal compartment 198. The internal compartment 198 is defined by lateral hem stitching 45 along sleeve ends 26 and 27, and longitudinal stitching 175. When desired, a hot or cold packet of material, such as a packet of fluid or granules (not shown), is inserted into the pocket 195, and the pocket is positioned over the fistula 10 to heat or cool the fistula.

Figure 5:
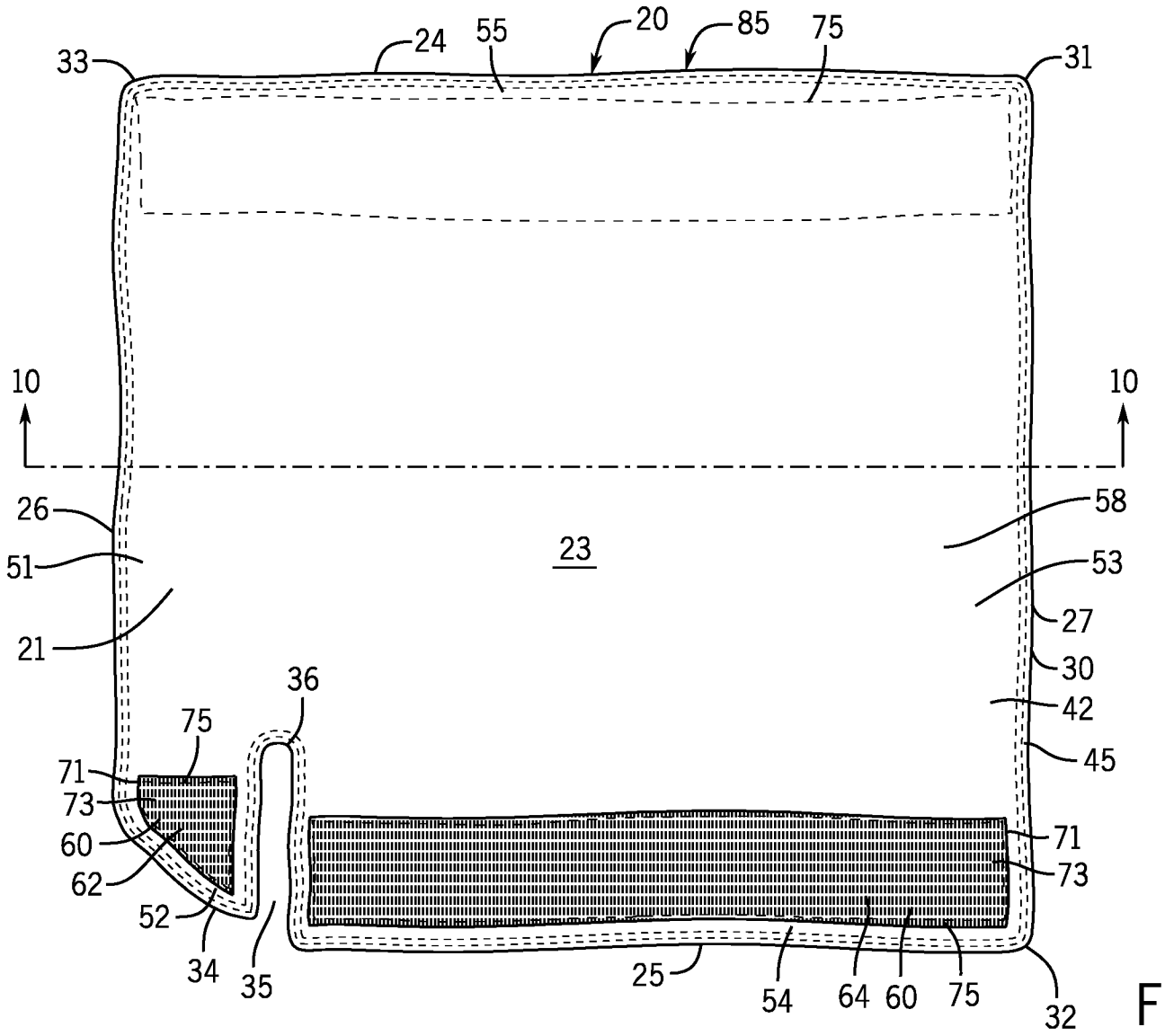
FIG. 5 is a bottom or inside view of the fistula sleeve.
Figure 6:
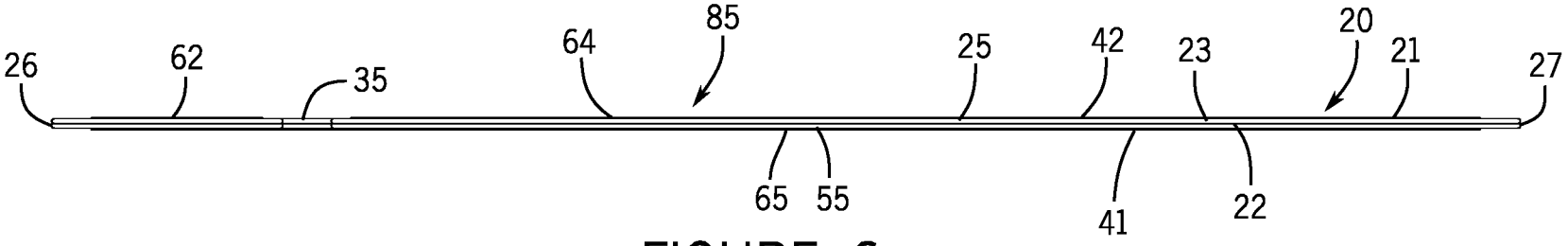
FIG. 6 is a first side view of the fistula sleeve.
Figure 7:
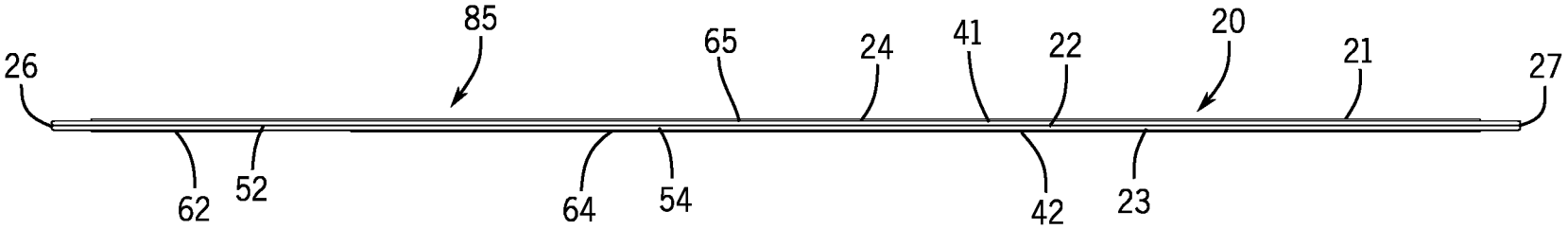
FIG. 7 is an opposite side view of the fistula sleeve.
Figure 8:
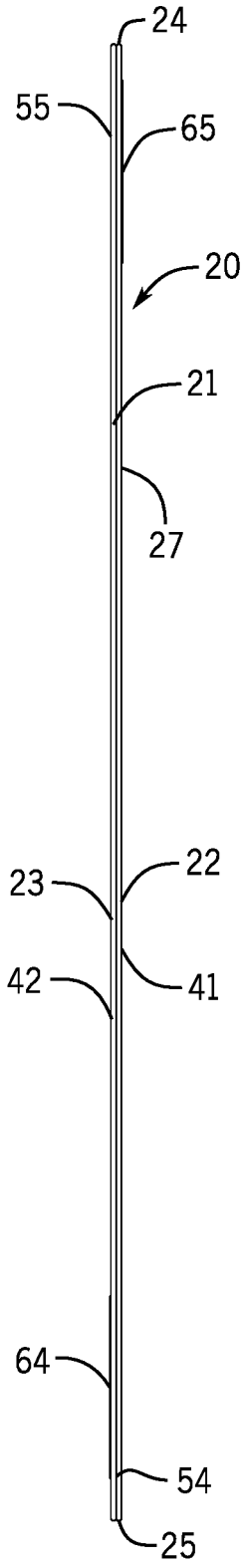
FIG. 8 is a rear or arm end view of the fistula sleeve.
Figure 9:
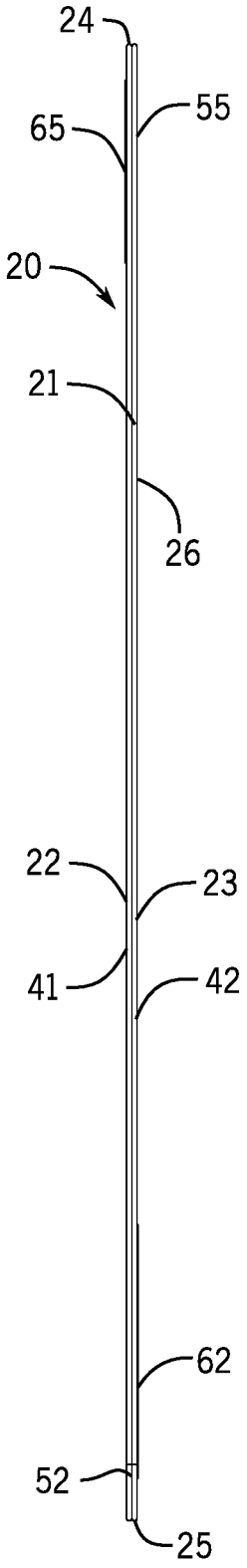
FIG. 9 is a front or wrist end view of the fistula sleeve.
Figure 10:
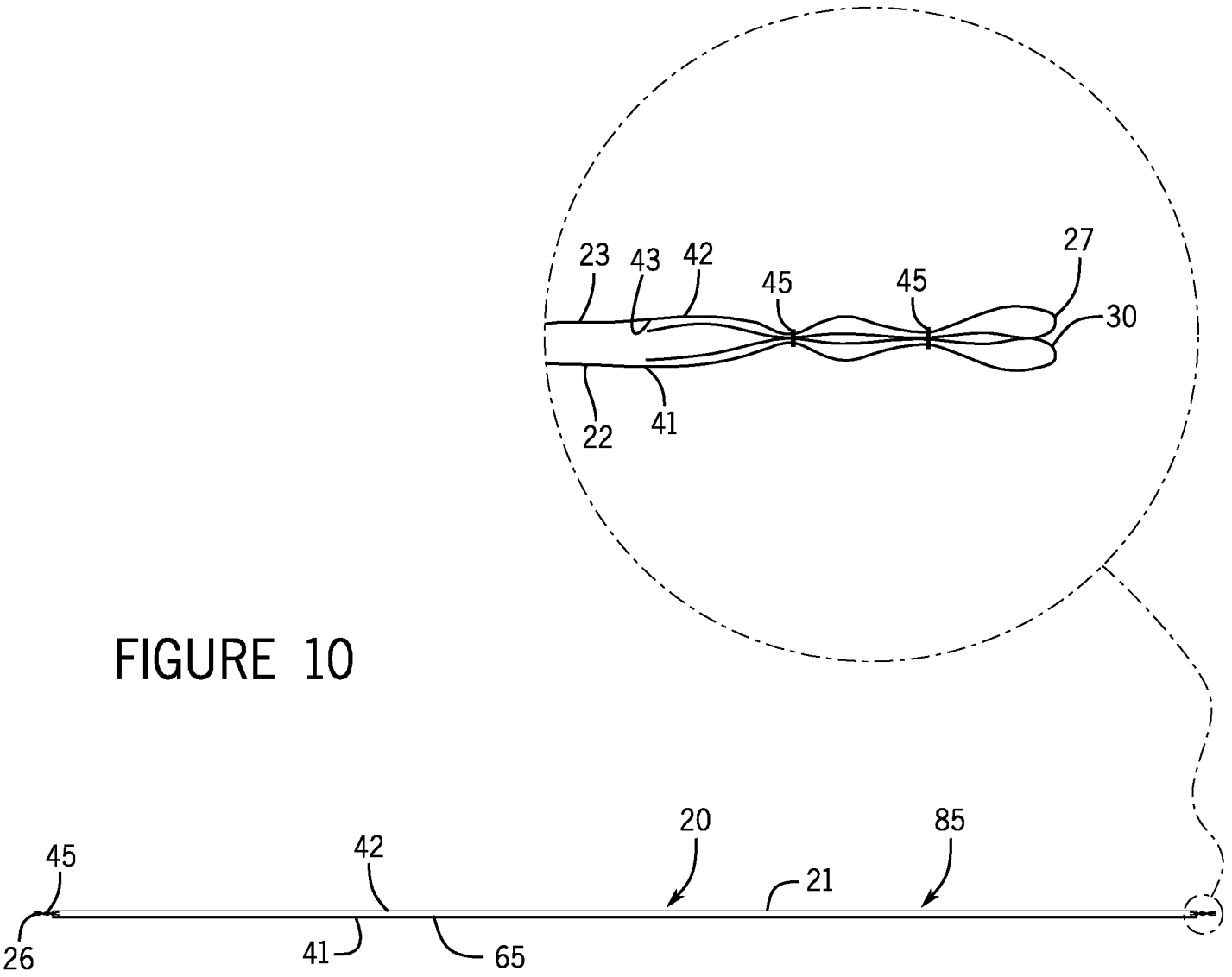
FIG. 10 is a sectional view taken along line 10-10 of FIG. 5 with an enlarged view showing the layers of material forming the sleeve and the double stitch hemming along the perimeter of the sleeve.

While the method of securing the sleeve 20 or 120 to the arm 2 of a person should be readily understood given the above, the following is provided to better explain how a person can secure the sleeve to his or her arm by using just the hand of his or her opposite arm, and how the person can gain access to the fistula 10 without removing the sleeve. When a convenient flat or reasonably firm supporting surface is available, the first step 200 is to lay out the sleeve 20, 120 on that surface with its inner surface 23 facing up. The felt strips 62 and 64 face up, and main hooking strip 65 faces down as shown in FIGS. 5 and 12. Any folds or kinks in the fabric 41 and 42 of the sleeve 20, 120 are smoothed out. The next step 210 is for the person to align his or her wrist 6 over wrist gripping region 51 and align the length 11 of his or her forearm 3 with the central axis 39 of the sleeve 20, 120. Next 215, the person rotates his or her arm 2 so that its inner surface 3*a* and fistula 10 faces down, and then lowers his or her arm onto the smooth inner surface 23 of central region 58. Next 220, using the opposed hand, the person grips and wraps the main securement flap 55 around the forearm 3 so that the main strip 65 faces up and is draped over and resting on the top of the forearm. The person removes his or her hand from the sleeve 20, 120. The next step 230 is to grip the wrist flap 52, wrap it around the wrist 6, and while continuing to keep the forearm wrist against the sleeve 20, 120, stretch the wrist gripping region 51 and secure wrist strip 62 to main strip 65 as seen in FIG. 2. Again, the person removes his or her hand from the sleeve 20, 120. The next step 240 is to grip the forearm flap 54, wrap it around the forearm 3, and while continuing to keep the forearm against the sleeve 20, 120, the forearm covering region 53 is brought taut so that it conforms to the contours 9 of the forearm 3 but is not significantly stretched, and the length of the forearm strip 64 is secured to the length of the main strip 65 as seen in FIG. 3.

The person wearing the sleeve 20, 120 gains access to the fistula 10 by first 250 rotating his or her arm so that the fistula 10 is facing up, and then 255 rotating the sleeve 20, 120 so the spine 80 is facing up. Then 260, gripping and pulling up on the forearm flap 54 to disengage the forearm strip 64 from the main securement strip 65, and unwrapping the central region 58 of the forearm covering region 53 to expose the fistula 10 as seen in FIG. 2. The forearm strip 64 releases via the upward pulling force on the forearm flap 54 without putting pressure on the fistula 10.

While the invention has been described with reference to a preferred embodiment, it will be understood by those skilled in the art that various changes may be made and equivalents may be substituted without departing from the broader aspects of the invention. For example, while the securement strips 60 are shown and described as being hook and loop type strips 62, 64 and 65, it should be understood that other types of securement strips can be used without departing from the broad aspects of the invention. While the sleeve 20, 120 is also shown and described as having felt strips 62 and 64 secured to wrist and forearm flaps 52 and 54, and a hooking strip 65 secured to main securement flap 55, it should be understood that a felt strip could be secured to main flap 55 and hooking strips could be secured to flaps 52 and 54 without departing from the broad aspects of the invention.

I claim:

1. A fistula sleeve for wearing on an arm of a person to protect a fistula, the arm having a wrist joint, a forearm, an elbow joint, an upper arm, inside, outside and side surfaces and a natural contour, said fistula extending generally longitudinally along and protruding from the natural contour of the inside surface of the arm, the fistula has a top surface and side surfaces, the side surfaces abruptly protruding from the natural contour of the arm, and said fistula sleeve comprising:

a main body formed by at least one about 1/32 inch thin layer of floppy, laterally stretchable fabric, said main body having first and second sleeve surfaces, first and second longitudinal sleeve sides, first and second lateral sleeve ends and a sleeve perimeter, and said main body including:

a lateral slot extending inwardly from said second sleeve side, said slot having an innermost slot end and defining a slot line extending from said innermost slot end to said first sleeve side, said lateral slot being a linear slot extending generally parallel to said first and second ends and generally perpendicular to said first and second sides;

a main flap extending longitudinally and continuously along said first sleeve side between said first and second sleeve ends, said main flap having a shorter forward portion, a longer rearward portion and a main securement strip fixed to said first sleeve surface, said main securement strip extending along said first sleeve side;

a joint flap located between said slot and said first sleeve end and having a joint securement strip fixed to said second sleeve surface;

an arm flap located between said slot and said second sleeve end and having an arm securement strip fixed to said second sleeve surface, said securement strips are semi-rigid securement strips, and each of said securement strips stiffening its said flap, said semi-rigid securement strips joining together to form a semi-rigid longitudinal spine;

a joint gripping region between said first end and said slot and slot line, said joint gripping region including said joint flap and said shorter forward portion of said main flap;

an arm covering region between said second end and said slot and slot line, said arm covering region including said arm flap and said longer rearward portion of said main flap, said arm covering region having a smooth central area between said main flap and said arm flap; and, wherein said sleeve is adapted to wrap around the arm with said joint securement strip securing to said shorter forward portion of said main securement strip in a laterally adjustable manner, said arm securement strip securing to said longer rearward portion of said main securement strip in an independently laterally adjustable manner, said joint gripping region is adapted to grip the arm proximal one of the joints to secure said sleeve to the arm, said longitudinal spine is adapted for positioning away from the longitudinally extending fistula, said arm covering region is adapted to snuggly and flushly engage the contours of the arm and the fistula with said smooth central area covering the fistula in a non-pressure generating manner, and said arm covering region is adapted to provide a gradually sloping contour between the natural contour of the arm and the top surface of the fistula.

2. The fistula sleeve of claim 1, and wherein said main securement strip is an integral securement strip extending continuously from said first sleeve end to said second sleeve end.

3. The fistula sleeve of claim 1, and wherein said main securement strip is a multi-piece strip having a shorter forward securement strip fixed to said shorter forward portion of said main flap and a longer rearward securement strip fixed to said longer rearward portion of said main flap, said forward and rearward securement strips being spaced apart by a gap.

4. The fistula sleeve of claim 3, and wherein said shorter forward securement strip is perpendicular to said longer rearward securement strip, and said shorter forward securement strip is positioned closer to said arm covering region than said longer rearward securement strip.

5. The fistula sleeve of claim 3, and wherein said joint flap includes a band fixed to said second sleeve side of said main body, said band extends laterally along said lateral slot, and said joint securement strip is fixed to said band.

6. The fistula sleeve of claim 1, and wherein said joint flap is a wrist flap, said joint gripping region is a wrist gripping region, and said arm covering region is a forearm covering region.

7. The fistula sleeve of claim 1, and wherein said joint flap is an elbow flap, said joint gripping region is an elbow gripping region, and said arm covering region is an upper arm covering region.

8. The fistula sleeve of claim 1, and wherein said spine provides sufficient rigidity to be gripped by just one hand to longitudinally and rotationally adjust said sleeve on the arm.

9. The fistula sleeve of claim 6, and wherein the arm is a forearm having a longitudinal length and a side surface with a laterally rounded shape, and said semi-rigid longitudinal spine is adapted to laterally conform to the laterally rounded shape of the side surface of the forearm as said spine extends along the longitudinal length of the forearm.

10. The fistula sleeve of claim 6, and wherein the arm is a forearm having a longitudinal length and an upper surface with a laterally flat shape, and said semi-rigid longitudinal spine is adapted to laterally conform to the laterally flat shape of the upper surface of the forearm as said spine extends along the longitudinal length of the arm.

11. The fistula sleeve of claim 1, and wherein said main body is formed by multiple layers of fabric including an outer layer and an inner layer that is adapted to engage the arm.

12. The fistula sleeve of claim 11, and wherein said layers of fabric are laterally stretchable.

13. The fistula sleeve of claim 12, and wherein said layers of fabric are made of a blend of spandex and one of either polyester and nylon filament.

14. The fistula sleeve of claim 13, and wherein said layers of fabric are about 3% to 20% spandex and about 80% to 97% one of either polyester and nylon filament.

15. The fistula sleeve of claim 11, and wherein said sleeve has a pocket forming an internal compartment, said outer layer has an opening to said internal compartment, said opening being selectively opened and closed, said pocket being formed between said outer and inner layers and located in said central area.

16. The fistula sleeve of claim 11, and wherein said outer and inner layers are in aligned registry, and said outer ends of each layer are folded inwardly around said perimeter of said main body and hemmed together with a double row of stitching.

17. The fistula sleeve of claim 11, and wherein said central area of said outer layer is free to move when snagged while said central area of said inner layer remains in place against the fistula.

18. The fistula sleeve of claim 1, and wherein said sleeve is adapted to lay substantially flat on a supporting surface to facilitate securing said sleeve to the arm with the use of just one hand.

19. The fistula sleeve of claim 12, and wherein each of said securement strips has a non-stretchable base and a strip perimeter, and each of said securement strips is fixed to an area of its said flap by stitching around its said strip perimeter, and each of said areas of said flap are non-stretchable.

20. The fistula sleeve of claim 1, and wherein said first sleeve surface is an upper sleeve surface and said second sleeve surface is a lower sleeve surface, said main securement strip being fixed to said upper sleeve surface, and said joint and arm securement strips being fixed to said lower sleeve surface.

21. The fistula sleeve of claim 20, and wherein said main securement strip includes a plurality of hooks, said joint and arm securement strips include a plurality of loops, said hooks and loops intermesh to secure said strips together in a selectively releasable manner when said joint and arm securement strips engage said main securement strip.

* * * * *